US008991026B2

(12) United States Patent
Blonder

(10) Patent No.: US 8,991,026 B2
(45) Date of Patent: Mar. 31, 2015

(54) ARTIFICIAL FLOWER NOVELTY AND ITS METHOD OF MANUFACTURE

(75) Inventor: Greg E. Blonder, Summit, NJ (US)

(73) Assignee: Tucker International LLC, Voorhees, NJ (US)

( * ) Notice: Subject to any disclaimer, the term of this patent is extended or adjusted under 35 U.S.C. 154(b) by 902 days.

(21) Appl. No.: 12/986,164

(22) Filed: Jan. 6, 2011

(65) Prior Publication Data

US 2011/0209325 A1 Sep. 1, 2011

Related U.S. Application Data

(60) Provisional application No. 61/292,831, filed on Jan. 6, 2010.

(51) Int. Cl.
*A41G 1/00* (2006.01)

(52) U.S. Cl.
CPC ..... *A41G 1/00* (2013.01); *Y10T 29/49826* (2015.01); *A41G 1/001* (2013.01); *Y10T 29/49366* (2015.01)
USPC ..... 29/428; 29/890.039; 428/24

(58) Field of Classification Search
CPC .... A41G 1/00; A41G 1/001; Y10T 29/49826; Y10T 29/49366
USPC ..... 29/428, 890.039, 505, 514, 521; 428/24, 25, 26
See application file for complete search history.

(56) References Cited

U.S. PATENT DOCUMENTS

| | | | |
|---|---|---|---|
| 2,561,217 | A | 7/1951 | Muir |
| 6,196,895 | B1 | 3/2001 | Elkins |
| 7,112,362 | B2 | 9/2006 | Blonder |

OTHER PUBLICATIONS

J. Barnard,"A Guide to Paper Flower Making", 1856, London.*

* cited by examiner

*Primary Examiner* — Ryan J Walters
(74) *Attorney, Agent, or Firm* — LaMorte & Associates, P.C.

(57) ABSTRACT

An artificial flower and the associated method of its manufacture. To produce the artificial flower, two films of material are laminated. The films of material have markedly different coefficients of thermal expansion. The laminate is formed into a curve shape. Petals and leafs are cut from the laminate. The petals and leafs are cut at different orientations across the curved shape. Accordingly, various petals and leaves change shape in different manners in response to changes in temperature. The various petals and leafs are then formed into an artificial flower.

11 Claims, 4 Drawing Sheets

ARTIFICIAL FLOWER NOVELTY AND ITS METHOD OF MANUFACTURE

RELATED APPLICATIONS

This application is a continuation-in-part of provisional patent application No. 61/292,831, entitled Artificial Flower, dated Jan. 6, 2010.

BACKGROUND OF THE INVENTION

1. Field of the Invention

The present invention relates to artificial flows that change shape in response to changes in ambient conditions.

2. Prior Art Description

Artificial flowers, made from plastic, silk or other materials, are a well developed technology. They are beautiful, require little or no maintenance, and remain colorful year-round. However, while lifelike in appearance, compared to real flowers, they are static and do not grow or react to the environment. In particular, real flowers are known to bend towards the sun, bloom over time, and often close their buds at night or in the cold.

Inventors have addressed this discrepancy through a variety of mechanical means. One approach constructs the flower's leaves out of a material which bends when heated, and unbends when cooled. For example, Muir in 1951 (U.S. Pat. No. 2,561,217) patented a nightlight whose coarse petal-like strips were made from a laminate of metal and paper. When heated by a light bulb, the paper expands at a faster rate than the metal, forcing the lamination to curl away from the paper side. However, this material is also sensitive to humidity which also causes the paper to expand/shrink, and the foil can take a permanent crease during handling, causing the petal to no longer bend.

Other inventors, such as Elkins 2001 (U.S. Pat. No. 6,196,895) use a plastic film. In this case, rather than a lamination of two materials of different expansion coefficients, the material is stressed by dragging over a sharp edge. This mechanical stress causes one side of the film to have a different polymeric structure than the other. While simple, this stress can relax over time such that the film no longer reacts to heat.

Blonder U.S. Pat. No. 7,112,362 describes a laminate of two plastics with a specific difference in expansion coefficient. Unlike Muir and Elkins, this film is stable. Blonder discloses a number of applications for this material, including very simple blooming flowers, a thermometer, a temperature indicator for coffee cups, etc. For purposes of the application, we denote a flower made of a material that bends reproducibly when exposed to a change in temperature, as a "thermactive flower", made from a "thermactive" lamination.

It is the object of this invention to improve on earlier uses for these temperature sensitive films, in particular, by employing those films in new and inventive flower applications, or by improving on a flower's function or realism.

SUMMARY OF THE INVENTION

The present invention is an artificial flower and the associated method of its manufacture. To produce the artificial flower, two films of material are laminated. The films of material have markedly different coefficients of thermal expansion. The laminate is formed into a curve shape. Petals and leafs are cut from the laminate. The petals and leafs are cut at different orientations across the curved shape. Accordingly, various petals and leaves change shape in different manners in response to changes in temperature. The various petals and leafs are then formed into an artificial flower.

DETAILED DESCRIPTION OF THE INVENTION

Before describing these inventive ideas, it is worth explaining the principles behind thermactive materials. The basic idea is similar to the more familiar metallic "bimetal" strips. Two materials of different thermal expansion are bonded (laminated) together. This structure constrains the laminated face of each film to be the same length, at all temperatures. However, if one film has a significantly larger expansion coefficient than the other (and is stiff enough not to compress), that film will try to grow longer when heated. The only way to accommodate this relative expansion is to curl. As is well known, on a racetrack the inner lane covers a shorter distance than the outer lane. In the same way, the film with the higher expansion coefficient (e.g. longer) will be on the outside of a curled film when heated, and on the inside when cooled. The film will be straight (e.g. not curled) at one intermediate temperature, called the "lay flat temperature". The lay flat temperature can be adjusted during the lamination process, and in the case of a thermactive flower, would typically be in the range of 70-80 degrees, so the flower petals are flat in a normal office or home environment.

Note "heating" the flower can be accomplished by many means. Clearly, one means is simple thermal contact with warm or cold air. Alternatively, a flower petal in the sun or under and incandescent bulb will absorb some of the light's heat (more if darkly colored, less if brightly colored). The exposed petal may heat by 20 C more than the surrounding air. With this preface in mind, we disclose the following:

Thermactive materials can be made symmetric with respect to temperature—that is, it curls one way when cold, and the other direction when heated. So, one could assemble a flower out of a multitude of petals with the LOW expansion layer oriented towards the center of the bud. Thus, when heated (whether in the sun or a warm room) the petal will curl TOWARDS the center of the flower, and not bloom. However, when cooled (say in the shade or a refrigerator) the flower will bloom. Such a flower either mimics real night blooming species (such as the moon flower *Ipomoea alba*) or could be associated with a fictional story. For example, a flower that blooms at night might be an appropriate gift from a vampire.

Since the flower only opens at a particular temperature (either hot or cold), one could create a small, "secret" storage niche in the center of the flower to hide or store a precious memento. For example, a girl might keep a boy's lock of hair in the flower. Or a man might propose to a woman by storing a ring in the flower, and having it open in the sun during a proposal.

Figure 1:
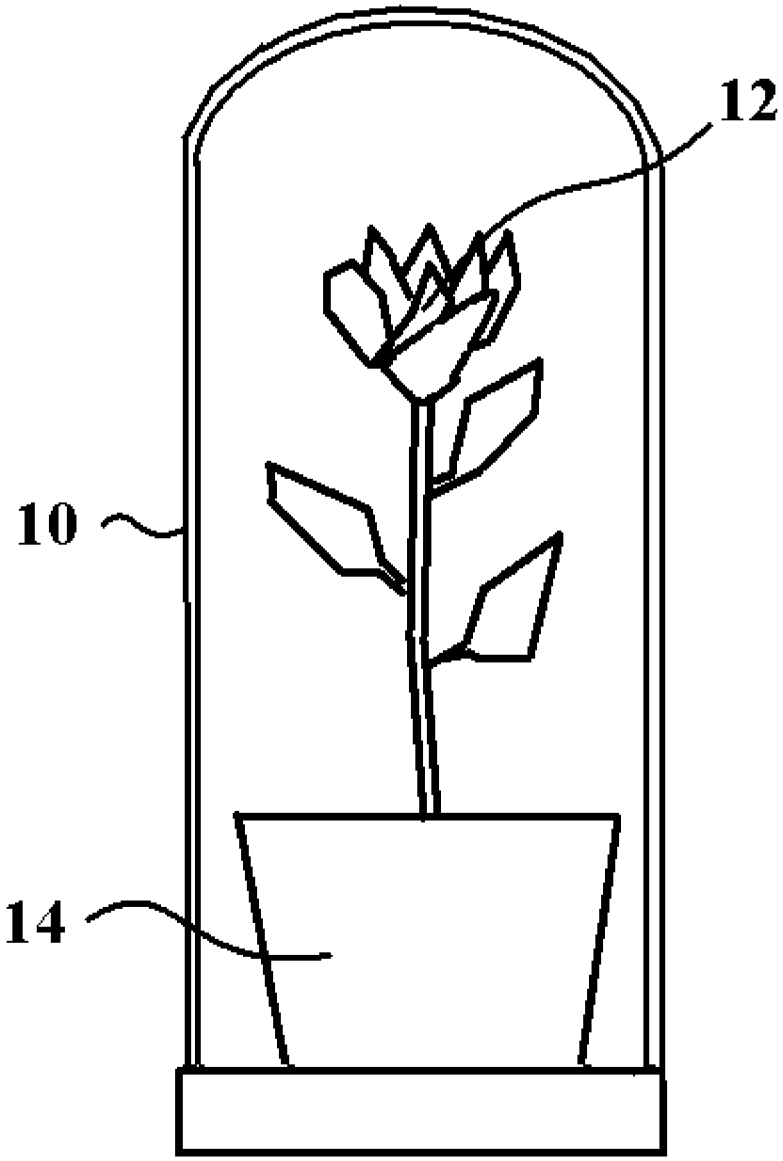
FIG. 1 is an exemplary embodiment of an artificial flower in a container.

While these inventive flowers may bloom in direct sunlight, on partly sunny days or in an interior room there may be insufficient light to heat the petals faster than they cool to the environment. For example, the flower may be placed on a windowsill in winter, and the cold air near the window will prevent sunlight from warming the petals sufficiently for motion. Our solution is to provide a removable or integrated greenhouse-like cover. Such a cover is shown in FIG. 1. Referring to FIG. 1, there is shown, a vacuum-formed double walled plastic bell jar 10 that fits over the flower 12 and flowerpot 14. Or a simple clear plastic bag that is slipped over an open wire frame. Advantageously, the bell jar 10 or bag has provisions to vent out excessive heat on particularly sunny days. For example, the bag could be furled or the bell jar lifted above the flowerpot 14, or the bell jar split and hinged vertically (like a tambour door on a roll-top desk). Note, in one example, the flower could be sold in a hanging package, contained within a thin clear "blister". This blister package could perform "double duty" as the greenhouse.

In some cases, the flower 12 might be desired to bloom on demand. For example, when placed in a vase. In this case, the flower's stem could be fashioned from a heat pipe (a technology well known in the art), and the flowerpot 14 filled with hot water. The heat pipe will conduct the water's warmth within the thermactive flower bud, causing it to open.

By evaporating or otherwise depositing a thin, high electrical resistance layer on the thermactive material, a thin-film heater is produced in intimate contact with the plastic. By attaching electrodes to the resistive metal, and passing current through the metal, heat is produced and very efficiently coupled into the thermactive material.

This combination of thermactive and resistive materials would allow a thermactive flower to bloom simply by attaching a battery and flipping a switch. Or, the flower could be linked, via a USB cable, to a computer. The flower might bloom whenever the weather report indicates clear skies, or close on bad news in the stock market.

Previous flower designs disclose only very simple petal arrangements—typically just a single ring of diamond-like flaps. Real flowers exhibit a much broader range of petal shapes. As the flower blooms, each petal may unfold in a unique way—some curl to the side, others bend directly away from the stamens. We have discovered a much more realistic and pleasing flower can be created by systematically mixing different petal types in one flower head.

Figure 2:
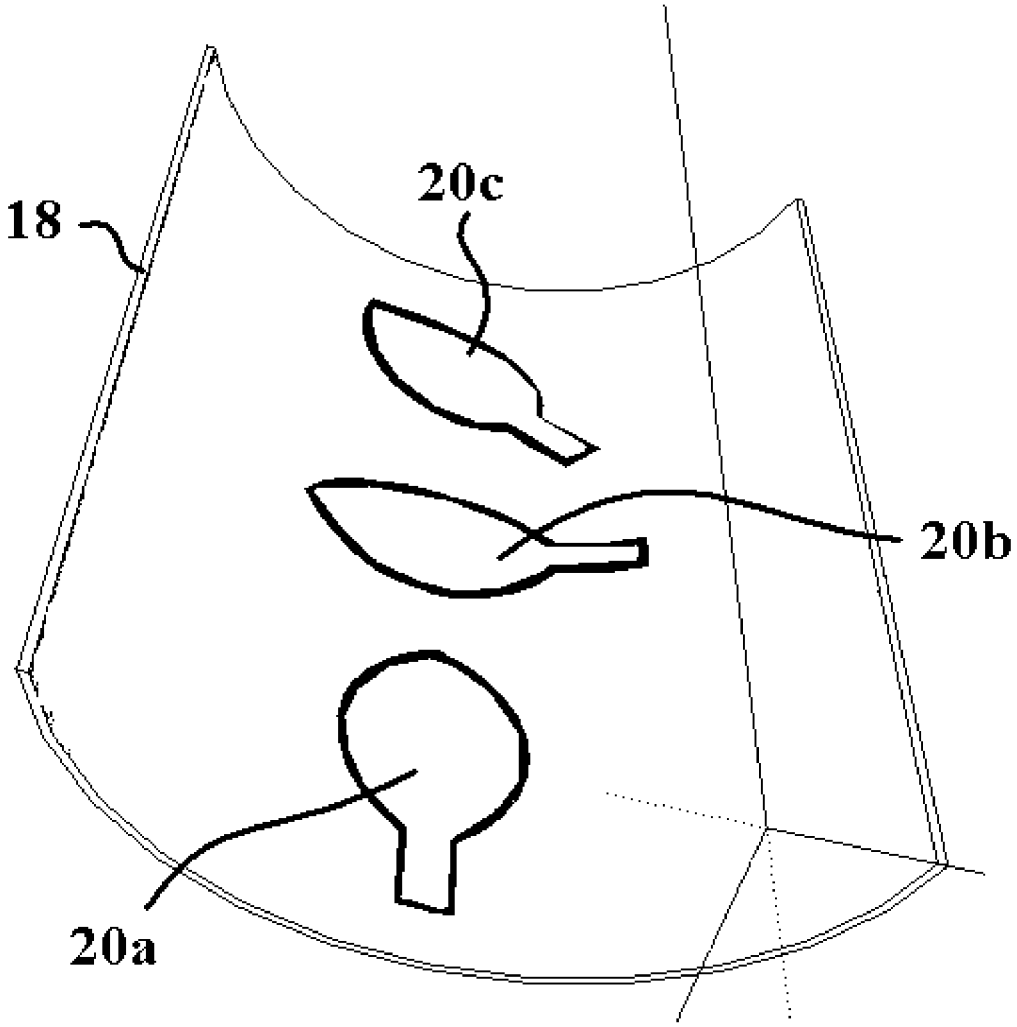
FIG. 2 is am exemplary embodiment of a laminate form shown petal cut patterns.

We have discovered that the flower petal's thermactive behavior is sensitively dependent on the axis of the petal relative to the axis of curl of the thermactive film 18. Referring to FIG. 2, it can be seen that the petals 20*a*, 20*b*, 20*c* might be aligned and cut along the thermactive's axis of curl (Zero degrees, in the middle petal 20*b*); perpendicular to the curl direction (ninety degrees, in petal 20*a*), or at a bias (forty five degrees, in petal 20*c*)

Figure 3:
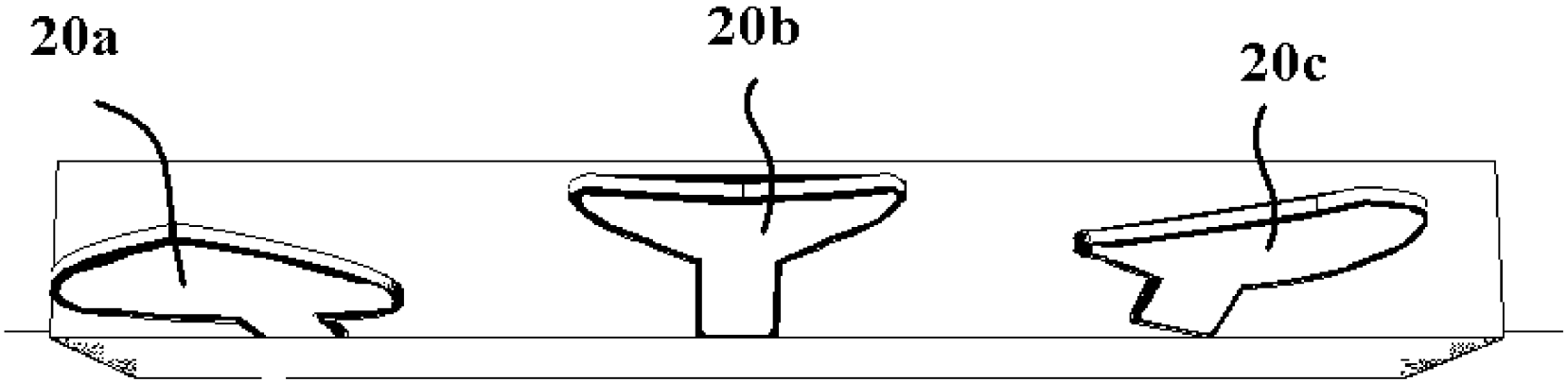
FIG. 3 shows exemplary embodiments of petals.

Referring to FIG. 3 and FIG. 2, it can be seen that after the petals 20*a*, 20*b*, 20*c* are cut from the film 18, and viewed from the tip of the petal towards the stem, it is clear the "0" degree petal 20*b* follows the simple curl of the original film, the "90" degree petal 20*a* is only slight bowed in the perpendicular direction, but is basically flat, and "45" degree petal 20*c* is twisted.

When heated or cooled, each of these petals 20*a*, 20*b*, 20*c* move in entirely different, but predictable, ways. For example, the "0" degree petal 20*b* will curl when cooled lower than the lay flat temperature, but will flatten above, and barely curl in the opposite direction. The "90" petal 20*a* exhibits the reverse behavior. And the "45" petal 20*c* will twist one way when cooled, and the opposite direction when heated (at very high excursions above or below the lay flat temperate, all petals 20*a*, 20*b*, 20*c* curl into a twisted ribbon.

These varied behaviors are of particular advantage in a thermactive flower. For example, the inner petals of a rose can be assembled from the 45 degree petals 20*c*, while the calyx petals along the exterior are cut along the 90 degree petals 20*a*. When heated, the tight rose bud would open into a mass of curled petals, while the calyx petals bend directly away from the stem—as in an actual rose.

In addition to carefully mixing different petals in one flower, there are advantages to mixing petals made from films with varied lay flat temperatures. For example, in the sun a black petal will bend much more quickly than a white petal, because it absorbs significantly more heat. If it is desired to have both black and white petals bend at the same time, a higher lay flat temperature thermactive film is used for the darker petal. Conversely, it may be desired to extend the temperature range over which the flower blooms. So, one might select petals made from a low lay flat temperature for the outer petals, and higher lay flat temperatures, for the inner petals. Then, as the day's temperature climbs, the bloom slowly transitions across the flower bud's radius.

If a petal is attached to a support, and that support is curved, the petal (at the lay flat temperature), will follow the curve and form a partial cylinder. This cylindrical shape stiffens the petal (as it does with any thin sheet), and before the petal can bend, it must overcome the shape-induced rigidity. So, when a curved petal is exposed to the sun, nothing happens until so much compressive energy is stored in the film, it suddenly bends over.

Figure 4:
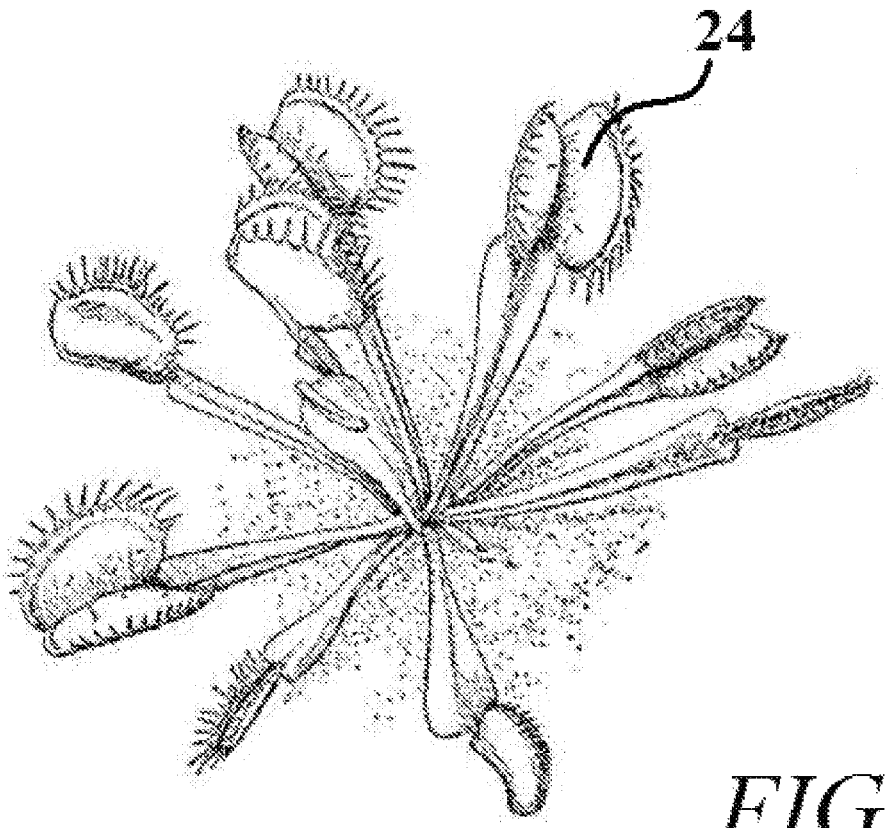
FIG. 4 shows an alternate embodiment of the present invention.

While curved mounting of a petal is typically disadvantageous, the phenomena can be harnessed advantageously. In FIG. 4, there is shown a Venus flytrap thermactive flower 24. Here, the two halves of the flytrap flower 24 are joined along a curved common axis, forming two intersecting cupped petals. When heated, the petals cannot bend easily. But at a high enough temperature, they will suddenly bend and snap shut. Decoratively, a small plastic fly may be glued to one petal. Or, as part of a game the player must try to dangle a fly in the trap at exactly the right time to be caught.

What is claimed is:

1. A method of fabricating an artificial flower, comprising the steps of:

forming a laminate by overlaying a first film of material over a second film of material, wherein said first film of material and said second film of material have dissimilar coefficients of thermal expansion;

curling said laminate about a straight axis of curl, therein forming a curved laminate;

cutting a plurality of separate and distinct petal types from said curved laminate, wherein each of said petal types is cut from said curved laminate at a different orientation with respect to said straight axis of curl; and forming said petal types into an artificial flower.

2. The method according to claim 1, wherein each of said petal types has a central axis around which said petal types are symmetrically cut.

3. The method according to claim 2, wherein said plurality of petal types include at least a first petal type, a second petal type and a third petal type.

4. The method according to claim 3, wherein said central axis of said first petal type is oriented at a perpendicular to said central axis of said third petal type when cut from said curved laminate.

5. The method according to claim 4, wherein said central axis of said second petal type is oriented at an acute angle relative to said central axis of said first petal type.

6. The method according to claim 1, wherein each of said petal types has the same shape.

7. A method of fabricating an artificial flower, comprising the steps of:

providing a laminate having a first surface and a second surface that embody dissimilar coefficients of thermal expansion, wherein said laminate changes shape in response to changes in temperature;

curling said laminate about an axis of curl, therein forming a curved laminate;

cutting separate and distinct petal types from said curved laminate, wherein each of said petal types is cut from said curved laminate in a different orientation in relation to said axis of curl; and forming said petal types into an artificial flower.

8. The method according to claim 7, wherein each of said petal types has a central axis around which said petal types are symmetrically cut.

9. The method according to claim 8, wherein said plurality of petal types include at least a first petal type, a second petal type and a third petal type.

10. The method according to claim 9, wherein said central axis of said first petal type is oriented at a perpendicular to said central axis of said third petal type when cut from said curved laminate.

11. The method according to claim 10, wherein said central axis of said second petal type is oriented at an acute angle relative to said central axis of said first petal type.

* * * * *